US009536390B2

(12) United States Patent
Ehrlich et al.

(10) Patent No.: US 9,536,390 B2
(45) Date of Patent: Jan. 3, 2017

(54) SERVING PATRONS IN A WAGERING GAME ENVIRONMENT

(75) Inventors: Dean A. Ehrlich, Arlington Heights, IL (US); Andrew Fowler, Chicago, IL (US); Mark B. Gagner, West Chicago, IL (US); Joel R. Jaffe, Glenview, IL (US); Shridhar P. Joshi, Naperville, IL (US); Mark C. Pace, Palatine, IL (US); Larry J. Pacey, Northbrook, IL (US); Christopher Green, San Francisco, CA (US); Kate H. Holmes, San Francisco, CA (US); Peter Petras, Salt Lake City, UT (US)

(73) Assignee: BALLY GAMING, INC., Las Vegas, NV (US)

( * ) Notice: Subject to any disclaimer, the term of this patent is extended or adjusted under 35 U.S.C. 154(b) by 1927 days.

(21) Appl. No.: 12/527,076

(22) PCT Filed: Feb. 12, 2008

(86) PCT No.: PCT/US2008/053692

§ 371 (c)(1),
(2), (4) Date: Nov. 5, 2010

(87) PCT Pub. No.: WO2008/103578

PCT Pub. Date: Aug. 28, 2008

(65) Prior Publication Data

US 2011/0045908 A1 Feb. 24, 2011

Related U.S. Application Data

(60) Provisional application No. 60/891,345, filed on Feb. 23, 2007, provisional application No. 61/023,312, filed on Jan. 24, 2008.

(51) Int. Cl.
*G07F 17/32* (2006.01)

(52) U.S. Cl.
CPC ..... *G07F 17/3255* (2013.01); *G07F 17/32* (2013.01); *G07F 17/3227* (2013.01); *G07F 17/3239* (2013.01)

(58) Field of Classification Search
CPC ... G07F 17/3218; G07F 17/3239; G07F 17/32
(Continued)

(56) References Cited

U.S. PATENT DOCUMENTS 5,429,361 A 7/1995 Raven et al.
5,971,271 A 10/1999 Wynn et al.
(Continued)

FOREIGN PATENT DOCUMENTS

WO WO-0105477 1/2001
WO WO-0224288 3/2002
(Continued)

OTHER PUBLICATIONS

"PCT Application No. PCT/US2008/053692 International Preliminary Report on Patentability", Aug. 7, 2009 , 14 pages.
(Continued)

*Primary Examiner* — David L Lewis
*Assistant Examiner* — Shauna-Kay Hall
(74) *Attorney, Agent, or Firm* — DeLizio Law, PLLC

(57) ABSTRACT

Systems and methods for serving patrons in a wagering game environment are described herein. In some embodiments, a method includes receiving patron service information, wherein the patron service information indicates activities of a patron in a casino. The method can also include selecting, based on the patron service information, a service for the patron, wherein the patron has not requested the service. Additionally, the method can include presenting a service order instructing a service attendant to deliver the service.

9 Claims, 15 Drawing Sheets

(58) Field of Classification Search
USPC ..... 463/42
See application file for complete search history.

(56) References Cited

U.S. PATENT DOCUMENTS

| | | | | |
|---|---|---|---|---|
| 5,999,808 | A | 12/1999 | LaDue | |
| 6,003,013 | A | 12/1999 | Boushy et al. | |
| 6,113,495 | A | 9/2000 | Walker et al. | |
| 6,139,431 | A | 10/2000 | Walker et al. | |
| 6,183,362 | B1 * | 2/2001 | Boushy | 463/25 |
| 6,264,560 | B1 | 7/2001 | Goldberg et al. | |
| 6,460,848 | B1 * | 10/2002 | Soltys et al. | 273/149 R |
| 6,530,835 | B1 | 3/2003 | Walker et al. | |
| 6,582,310 | B1 | 6/2003 | Walker et al. | |
| 6,712,696 | B2 * | 3/2004 | Soltys et al. | 463/25 |
| 6,712,702 | B2 | 3/2004 | Goldberg et al. | |
| 6,852,031 | B1 | 2/2005 | Rowe | |
| 7,022,017 | B1 * | 4/2006 | Halbritter et al. | 463/42 |
| 7,311,605 | B2 * | 12/2007 | Moser | 463/25 |
| 7,611,407 | B1 * | 11/2009 | Itkis | G07F 17/32 380/251 |
| 7,850,528 | B2 * | 12/2010 | Wells | 463/42 |
| 7,874,919 | B2 * | 1/2011 | Paulsen et al. | 463/39 |
| 7,927,213 | B2 * | 4/2011 | Norton et al. | 463/29 |
| 7,945,477 | B2 * | 5/2011 | Werbitt | 705/15 |
| 7,967,682 | B2 * | 6/2011 | Huizinga | 463/42 |
| 8,087,996 | B2 * | 1/2012 | Walker et al. | 463/25 |
| 2002/0050683 | A1 * | 5/2002 | Hirota | G07F 17/32 273/121 B |
| 2002/0098888 | A1 * | 7/2002 | Rowe et al. | 463/39 |
| 2002/0116284 | A1 | 8/2002 | Steelman et al. | |
| 2002/0142846 | A1 | 10/2002 | Paulsen | |
| 2002/0183106 | A1 | 12/2002 | Cole | |
| 2002/0187834 | A1 * | 12/2002 | Rowe et al. | 463/42 |
| 2003/0003997 | A1 * | 1/2003 | Vuong et al. | 463/42 |
| 2003/0013516 | A1 | 1/2003 | Walker et al. | |
| 2003/0032474 | A1 * | 2/2003 | Kaminkow | 463/25 |
| 2003/0050806 | A1 | 3/2003 | Friesen et al. | |
| 2003/0069071 | A1 | 4/2003 | Britt et al. | |
| 2003/0087695 | A1 | 5/2003 | Walker et al. | |
| 2003/0100372 | A1 | 5/2003 | Gatto et al. | |
| 2003/0176213 | A1 | 9/2003 | LeMay et al. | |
| 2003/0176218 | A1 | 9/2003 | LeMay et al. | |
| 2003/0211881 | A1 | 11/2003 | Walker et al. | |
| 2003/0211889 | A1 | 11/2003 | Walker et al. | |
| 2004/0002386 | A1 * | 1/2004 | Wolfe et al. | 463/42 |
| 2004/0005918 | A1 | 1/2004 | Walker et al. | |
| 2004/0048670 | A1 | 3/2004 | Rowe | |
| 2004/0106454 | A1 * | 6/2004 | Walker et al. | 463/42 |
| 2004/0127284 | A1 * | 7/2004 | Walker et al. | 463/30 |
| 2005/0009600 | A1 * | 1/2005 | Rowe et al. | 463/29 |
| 2005/0054439 | A1 | 3/2005 | Rowe et al. | |
| 2005/0054441 | A1 | 3/2005 | Landrum et al. | |
| 2005/0101383 | A1 * | 5/2005 | Wells | 463/39 |
| 2005/0282626 | A1 * | 12/2005 | Manfredi et al. | 463/25 |
| 2006/0148551 | A1 * | 7/2006 | Walker et al. | 463/16 |
| 2006/0264257 | A1 * | 11/2006 | Jaffe et al. | 463/20 |
| 2007/0015569 | A1 | 1/2007 | Norton et al. | |
| 2007/0060355 | A1 * | 3/2007 | Amaitis et al. | 463/40 |
| 2007/0087834 | A1 * | 4/2007 | Moser et al. | 463/42 |
| 2008/0039193 | A1 * | 2/2008 | Muir et al. | 463/25 |
| 2008/0096659 | A1 * | 4/2008 | Kreloff | G07F 17/3209 463/39 |

FOREIGN PATENT DOCUMENTS

| | | |
|---|---|---|
| WO | WO-0229658 | 4/2002 |
| WO | WO-0231739 | 4/2002 |
| WO | WO-0243019 | 5/2002 |
| WO | WO-03045518 | 6/2003 |
| WO | WO-2004024269 | 3/2004 |

OTHER PUBLICATIONS

"PCT Application No. PCT/US2008/053692 International Search Report", Jul. 18, 2008 , 8 pages.
"Australian Application No. 2013237726 Patent Examination Report", Jun. 16, 2015, 4 pages.
Co-pending U.S. Appl. No. 14/863,846, filed Sep. 24, 2015, 47 pages.
Canadian Application No. 2,678,973 Examination Report, Nov. 24, 2015, 5 pages.

* cited by examiner

SERVING PATRONS IN A WAGERING GAME ENVIRONMENT

RELATED APPLICATIONS

This application claims priority benefit of U.S. Provisional Application Ser. No. 60/891,345 filed Feb. 23, 2007 and U.S. Provisional Application Ser. No. 61/023,312 filed Jan. 24, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2008, WMS Gaming, Inc.

FIELD

Embodiments of the inventive subject matter relate generally to wagering game systems, and more particularly to systems for serving patrons in a wagering game environment.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

Techniques for serving patrons in a wagering game environment are described below. In some embodiments, a computer-implemented method comprises receiving patron service information, wherein the patron service information indicates activities of a patron in a casino. The computer-implemented method can also include selecting, based on the patron service information, a service for the patron, wherein the patron has not requested the service, and dispatching a service attendant to deliver the service.

In some embodiments, the activities include movements of the patron in the casino.

In some embodiments, the activities include playing wagering games.

In some embodiments, the patron service information includes wagering game information indicating one or more of the group consisting of wagering games played by the patron, number of wagering games played by the patron, amount wagered by the patron in a period of time, and time spent in the casino by the patron.

In some embodiments, the patron service information is received over a wireless connection from a handheld wagering game machine.

In some embodiments, the service is selected from the group consisting of drink service, food service, reservations service, technical support, and casino information service.

In some embodiments, the method further comprises releasing a device to the patron, wherein the device is configured to submit the patron service information.

In some embodiments, the method further comprises transmitting a multimedia stream that includes communications from the service attendant.

In some embodiments, the multimedia stream is prerecorded.

In some embodiments, an apparatus comprises a service information controller configured to receive patron service information, wherein the patron service information indicates activities of a patron in a casino. The apparatus can also include a service selection controller configured to select, based on the patron service information, a service for the patron, wherein the patron has not requested the service. The apparatus can also include a dispatch controller configured to dispatch a service attendant to deliver the service.

In some embodiments, the apparatus further comprises a media controller configured to transmit a multimedia stream that includes communications from a service attendant.

In some embodiments, the activities include movements of the patron in the casino.

In some embodiments, the activities include playing wagering games.

In some embodiments, the patron service information includes wagering game information indicating one or more of the group consisting of wagering games played by the patron, number of wagering games played by the patron, amount wagered by the patron in a period of time, and time spent in the casino by the patron.

In some embodiments, a wagering game machine comprises a wagering game unit configured to present wagering games to a patron. The wagering game machine can also include a location unit configured to generate location information indicating movements of the wagering game machine in a casino. The wagering game machine can also include a service information controller configured to submit service information for use in selecting a service for the patron, wherein the service information includes the location information and information about the wagering games.

In some embodiments, the service is selected from the group consisting of drink service, food service, reservations service, technical support, and casino information service.

In some embodiments, the information about the wagering games includes one or more selected from the group consisting of type of wagering games played, number of wagering games played, amount wagered in a period of time, and duration of wagering game session.

In some embodiments, the location unit includes a global positioning system receiver.

In some embodiments, the location unit includes a radio frequency identifier tag.

In some embodiments, a display device configured to present an indication of the service and communications from a service attendant.

A wagering game system comprising a wagering game machine configured to present wagering games and to submit service information associated with a patron, wherein the service information includes information about the wagering games; a patron services server configured to obtain the service information and to select, based at least in part on the service information, a service for the patron.

In some embodiments, the patron has not requested the service.

In some embodiments, the service information includes information about where the gaming machine is located in a casino.

In some embodiments, a patron services terminal configured to present a service order instructing a service attendant to deliver the selected service to the patron.

In some embodiments, an awards server configured to award the patron a promotional item, to associate the promotional item with an account of the patron, and to reveal the promotional item during a future wagering game session.

In some embodiments, a method comprises receiving a plurality of page request messages, wherein each page request message requests notification when one or more of a group of wagering game machines is available. The method can also include receiving status messages from the group of wagering game machines, where the status messages indicate which of the group are available and which of the group are in-use. The method can also include determining, for each of the page request messages, that one of the group of wagering game machines is available, wherein the determining is based on the status messages. The method can also include transmitting, for each of the plurality of page request messages, a notification indicating that the one or more of the group of wagering machines is available.

In some embodiments, the page request messages indicate whether the notification is to be a text message, telephone call, or email.

In some embodiments, one or more of the page request messages indicate a time period after which no notification should be sent.

In some embodiments, the notification is a text message to a mobile telephone.

In some embodiments, the notification includes directions to the one or more of the group of wagering game machines.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into five sections. The first section provides an introduction to embodiments of the invention, while the second section describes example architectures. The third section describes example operations performed by some embodiments and the fourth section describes example wagering game machines in more detail. The fifth section presents some general comments.

Introduction

This section provides an introduction to some embodiments of the invention.

Casinos are constantly striving to build loyalty with their valued patrons (e.g., high rollers, frequent guests, celebrities, etc.). Some casinos build patron loyalty by providing complementary goods and services. For example, after a valued patron checks into a casino hotel, hotel staff may deliver a gift basket or other complimentary merchandise to the patron's hotel room. Some casinos also provide complementary goods or services on the casino floor. For example, when valued patrons present players' club cards, casino staff may offer complementary beverages or other services. While these types of services may build some patron loyalty, embodiments of the invention enable casinos to select and deliver services that maximize patron satisfaction.

Some embodiments of the invention include a casino service system that enables casino staff to track where patrons move and what patrons do in a casino. When patrons go to certain parts of a casino or when they engage in certain activities (e.g., playing wagering game machines), some embodiments of the casino service system can prompt casino staff to deliver services that enhance the patron's casino experience. In some embodiments, the patrons themselves do not directly request services. Instead, the casino service system can request services based on the patrons' movements and activities. For example, after a patron has been standing at gaming table for a certain time period, the casino system can, without a direct request from the patron, prompt staff to deliver the patron's favorite drink. As another example, after the patron has spent a certain amount of money at a wagering game machine, the casino service system can prompt staff to personally meet and greet the patron. The discussion of FIG. 1 describes these and other embodiments in more detail.

Figure 1:
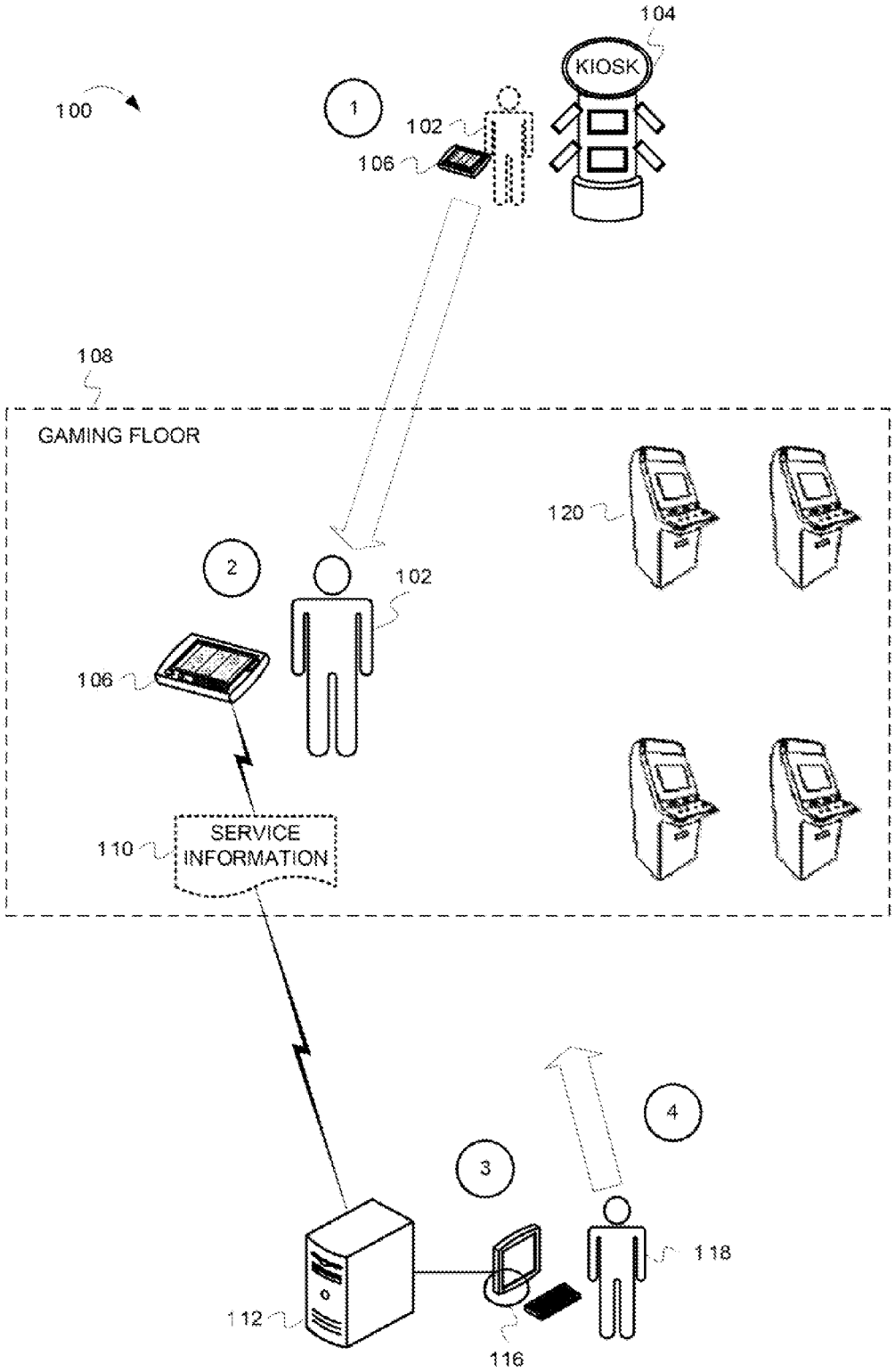
FIG. 1 is a diagram illustrating how some embodiments of a casino service system can prompt casino staff to deliver services to a patron.

FIG. 1 is a diagram illustrating how some embodiments of a casino service system can prompt casino staff to deliver services to a patron. In FIG. 1, the casino service system 100 includes a handheld wagering game machine 106, kiosk 104, freestanding wagering game machines 120, patron services server 112, and service notification terminal 116. FIG. 1 shows four stages of operation.

During stage one, in a casino, a patron 102 checks-out a handheld wagering game machine 106 from the kiosk 104. The handheld wagering game machine 106 includes components that allow the casino service system 100 to track the patron's movements and activities. During stage two, as the patron 102 walks onto the casino floor 108, the handheld wagering game machine 106 wirelessly transmits service information 110 to the patron services server 112. The service information can include information about the patron's location on the gaming floor 108 and information about the patron's activities (e.g., an indication about how many wagering games the patron 102 has played).

During stage three, the patron services server 112 uses the service information 110 to select goods/services for the patron 102. Additionally, the patron services server 112 presents a service notification to the casino attendant 118 via the service notification terminal 116. During stage four, the casino attendant 118 delivers to the casino floor 108 the goods/services indicated in the service notification. As a result, the casino system 100 enables casino staff to deliver highly personalized service. Furthermore, as noted above, some embodiments prompt casino staff to deliver goods/services without patrons directly asking for the services. Although FIG. 1 describes some embodiments, the following sections describe many other features and embodiments.

Example Architectures

This section describes structural aspects of some embodiments. In particular, this section presents example wagering game machine and wagering game network architectures.

Wagering Game Networks

Figure 2:
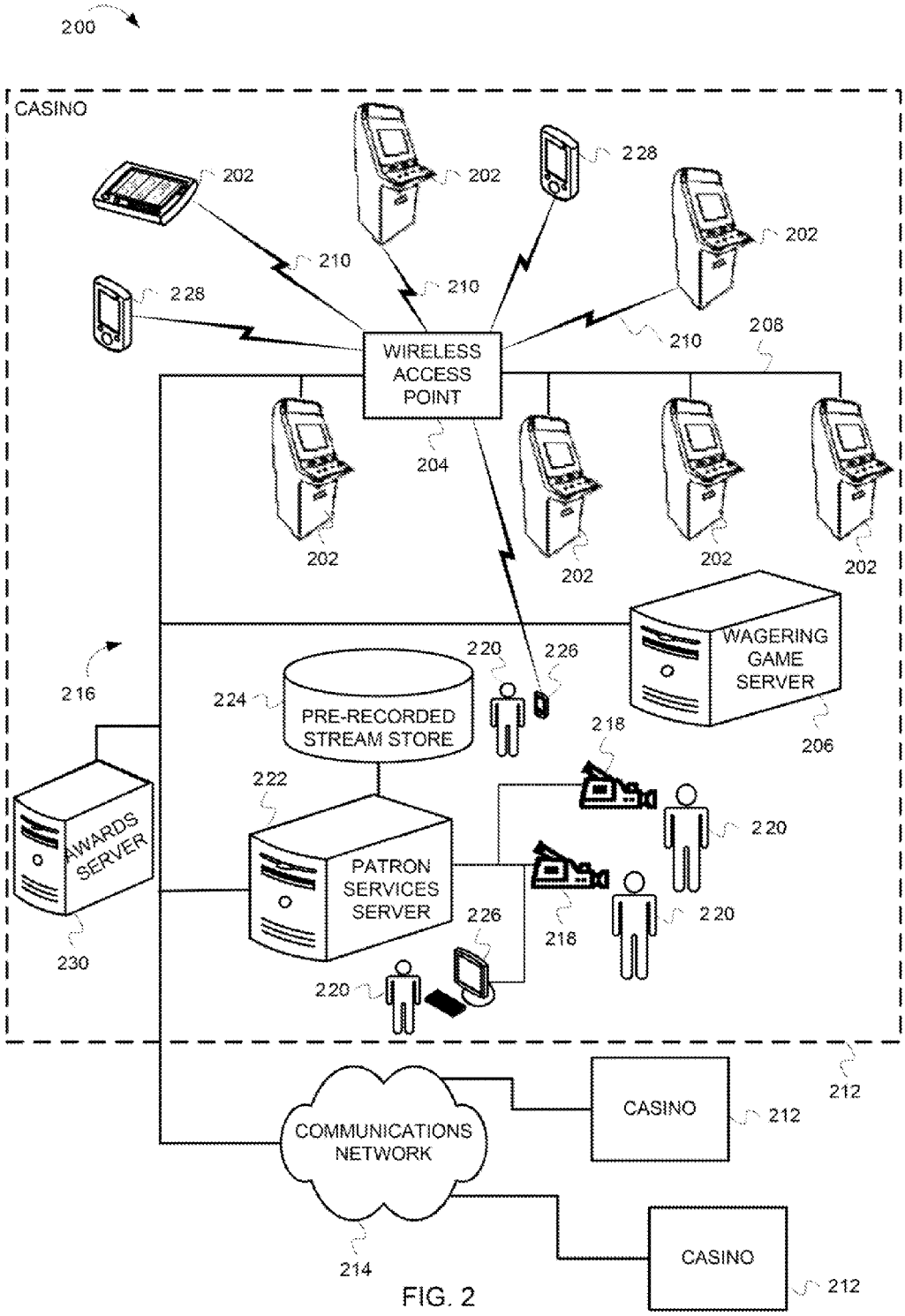
FIG. 2 is a block diagram illustrating a wagering game network 200, according to example embodiments of the invention.

FIG. 2 is a block diagram illustrating a wagering game network 200, according to example embodiments of the invention. As shown in FIG. 2, the wagering game network 200 includes a plurality of casinos 212 connected to a communications network 214. In some embodiments, the communications network 214 includes public telephone networks, the Internet, etc. Each casino 212 includes a local area network (LAN) 216, which includes an access point 204, patron service devices 228, patron services server 222, patron services terminal 226, pre-recorded stream store 224, audio/video capture devices 218, wagering game server 206, awards server 230, and wagering game machines 202.

The access point 204 provides wireless communication links 210 and wired communication links 208 to devices of the LAN 216. The wired and wireless communication links can employ any suitable connection technology, such as Bluetooth, 802.11g, Ethernet, public switched telephone networks, SONET, etc.

The patron service devices 228 can provide patron service information (e.g., a patron identifier and information about the patron's location and activities) to the patron services server 222 and other network devices. The patron services server 222 can use the patron service information to make decisions about where and when to deliver goods and services to patrons. Additionally, the patron services server 222 can help provide services by transmitting live and prerecorded media streams. For example, the patron services server 222 can transmit live media streams that enable service attendants 220 to provide technical support, concierge services, and other services to patrons who are using wagering game machines 202 and patron service devices 228.

In some embodiments, the wagering game server 206 can serve wagering games and distribute content to any device in the casinos 212 or other locations on the communications network 214. The wagering game machines 202 can exchange content with the wagering game server 206 and present wagering games, such as slots, blackjack, poker, etc. The wagering game machines 202 can also transmit patron service information to the patron services server 222. Moreover, in some embodiments, the wagering game machines 202 can present live and prerecorded media streams in which service attendants provide interactive services.

The wagering game machines 202 can take any suitable form, such as floor standing models, handheld mobile units, bartop models, workstation-type console models, etc. Further, the wagering game machines 202 can be primarily dedicated for use in conducting wagering games, or can include non-dedicated devices, such as mobile phones, personal digital assistants, personal computers, etc. In some embodiments, the wagering game network 200 can include other network devices, such as accounting servers, wide area progressive servers, player tracking servers, and/or other devices suitable for use with embodiments of the invention.

In some embodiments, wagering game machines 202 and wagering game servers 206 work together such that a wagering game machine 202 can be operated as a thin, thick, or intermediate client. For example, one or more elements of game play may be controlled by the wagering game machine 202 (client) or the wagering game server 206 (server). Game play elements can include executable game code, lookup tables, configuration files, game outcome, audio or visual representations of the game, game assets or the like. In a thin-client example, the wagering game server 206 can perform functions such as determining game outcome or managing assets, while the wagering game machine 202 can present a graphical representation of such outcome or asset modification to the user (e.g., player). In a thick-client example, the wagering game machines 202 can determine game outcomes and communicate the outcomes to the wagering game server 206 for recording or managing a player's account.

In some embodiments, either the wagering game machines 202 (client) or the wagering game server 206 can provide functionality that is not directly related to game play. For example, account transactions and account rules may be managed centrally (e.g., by the wagering game server 206) or locally (e.g., by the wagering game machine 202). Other functionality not directly related to game play may include power management, presentation of advertising, software or firmware updates, system quality or security checks, etc.

Any of the wagering game network components (e.g., the wagering game machines 202) can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Wagering Game Machines

Figure 3:
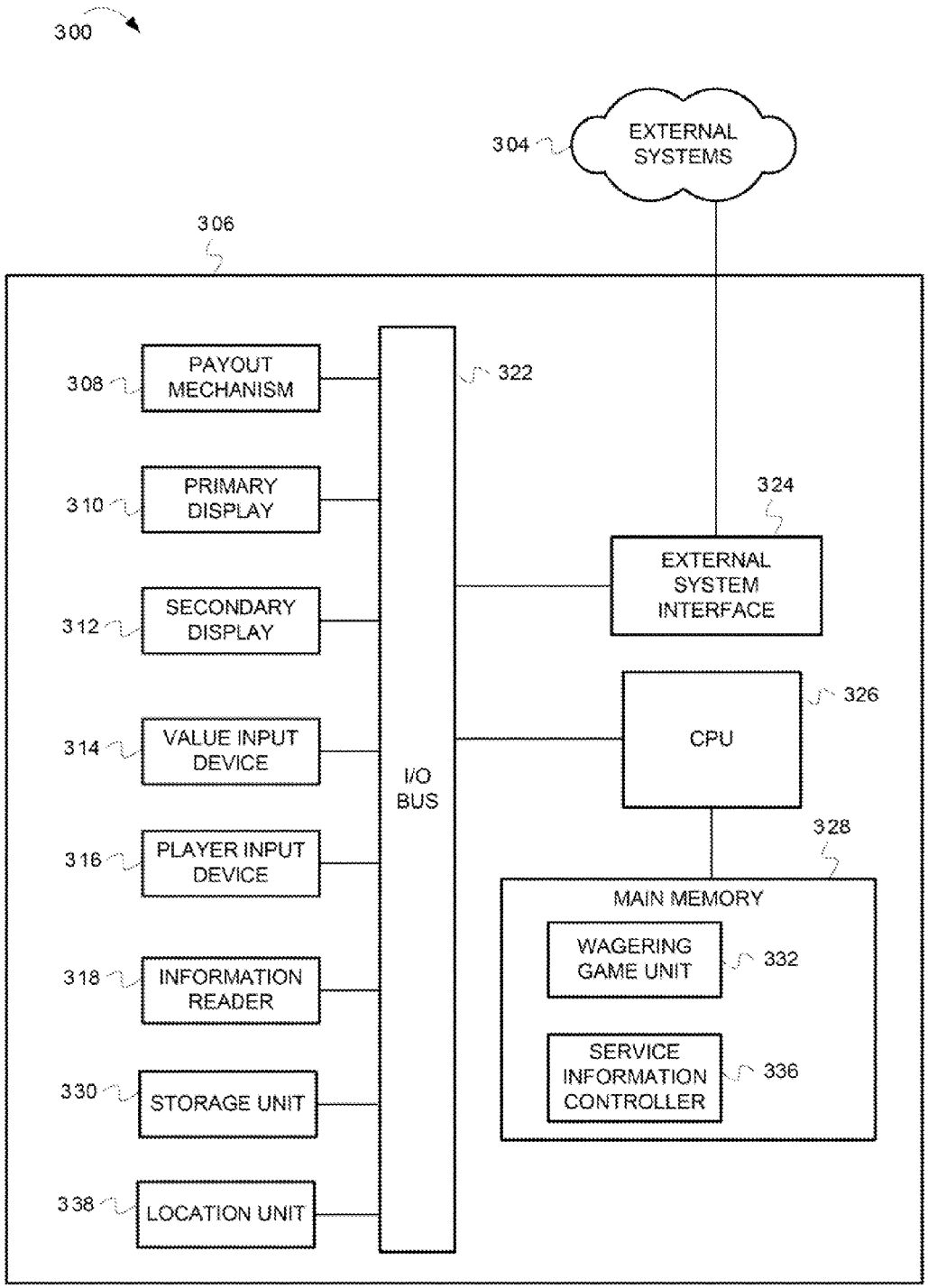
FIG. 3 is a block diagram illustrating a wagering game machine architecture, according to example embodiments of the invention.

FIG. 3 is a block diagram illustrating a wagering game machine architecture, according to example embodiments of the invention. As shown in FIG. 3, the wagering game machine architecture 300 includes a wagering game machine 306, which includes a central processing unit (CPU) 326 connected to main memory 328. The CPU 326 can include any suitable processor, such as an Intel® Pentium processor, Intel® Core 2 Duo processor, AMD Opteron™ processor, or UltraSPARC processor.

The main memory 328 includes a wagering game unit 332 that can present wagering games, in whole or part. The main memory 328 also includes a service information controller 336. In some embodiments, the service information controller 336 can transmit patron service information (e.g., patron identifier, patron activity information, and patron location information) to a patron services server or other device.

The CPU 326 is connected to an input/output (I/O) bus 322, which can include any suitable bus technologies, such as an AGTL+ frontside bus and a PCI backside bus. The I/O bus 322 is connected to a payout mechanism 308, primary display 310, secondary display 312, value input device 314, player input device 316, information reader 318, storage unit 330, and location unit 338. The player input device 316 can include the value input device 314 to the extent the player input device 316 is used to place wagers. The I/O bus 322 is also connected to an external system interface 324, which is connected to external systems 304 (e.g., wagering game networks). The external system interface 324 can include logic for exchanging information over wired and wireless networks (e.g., 802.11g transceiver, Bluetooth transceiver, Ethernet transceiver, etc.)

The I/O bus 322 is also connected to a location unit 338. The location unit 338 can create information that indicates the wagering game machine's location in a casino. In some embodiments, the location unit 338 includes a global positioning system (GPS) receiver that can determine the wagering game machine's location using GPS satellites. In other embodiments, the location unit 338 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 3, in some embodiments, the location unit 338 is not connected to the I/O bus 322.

In some embodiments, the wagering game machine 306 can include additional peripheral devices and/or more than one of each component shown in FIG. 3. For example, in some embodiments, the wagering game machine 306 can include multiple external system interfaces 324 and/or multiple CPUs 326. In some embodiments, any of the components can be integrated or subdivided.

This section continues with a discussion about patron service devices.

Patron Service Devices

Figure 4:
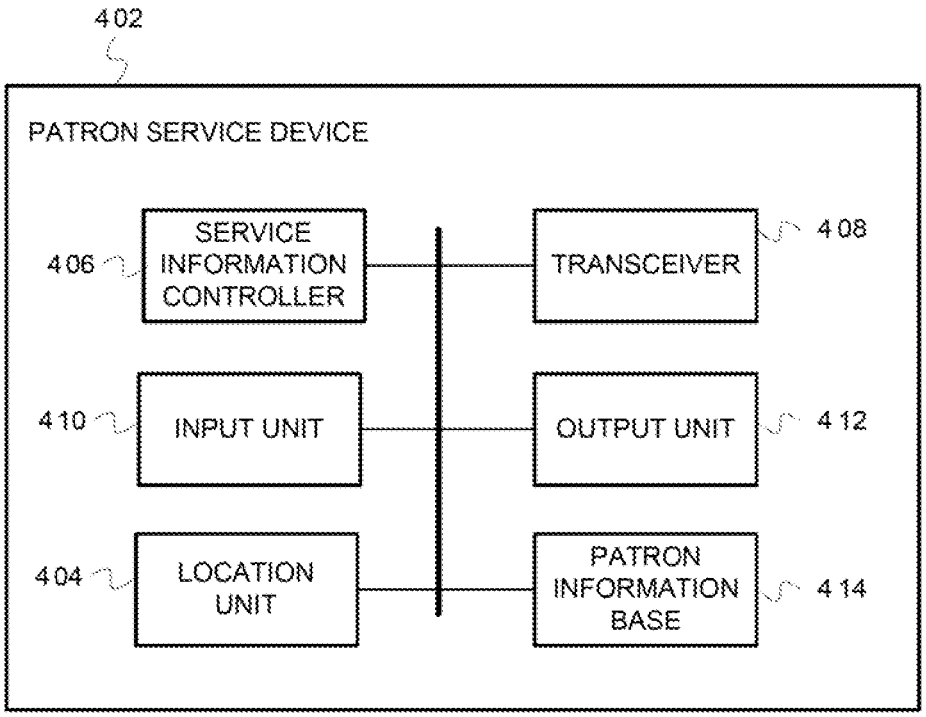
FIG. 4 is a block diagram illustrating a patron service device architecture, according to example embodiments of the invention.

Casinos can use patron service devices to provide personalized service to valued patrons. In some embodiments, patrons can carry patron service devices that transmit information about the patrons' movements, activities, interactions, etc. The casino service system can use the information to determine when and where to dispatch casino staff or otherwise provide patron services (e.g., provide directions, make reservations, take drink orders, etc.). FIG. 4 provides additional details about patron services devices.

FIG. 4 is a block diagram illustrating a patron service device architecture, according to example embodiments of the invention. In FIG. 4, a patron service device 402 includes a patron information base 414, location unit 404, service information controller 406, transceiver 408, input unit 410, and output unit 412. The patron information base 402 can include information about a patron, such as a patron identifier and other personal and wagering-game-related information. The location unit 404 can track the location of the patron service device 402 in a casino. The location unit 404 can include a GPS receiver, RFID device, or other device used for determining the patron service device's location. The service information controller 406 can provide (wirelessly or over a wired connection) location information and other patron service information to a patron services server via the transceiver 408. Furthermore, the service information controller 406 can provide information from the patron information base 414 to wagering game machines, enabling the patron service device to interact with various player tracking systems. The input unit 410 unit can include buttons, touch pads, microphones, etc., while the output unit 412 can include speakers, video devices, etc.

In some embodiments, patrons can use the patron service device 402 to participate in live table wagering games (e.g., craps). For example, the patron service device 402 can transmit betting information to a wagering game server that is monitoring the table game. The wagering game server can settle bets by crediting or debiting patron accounts.

Figure 5A:
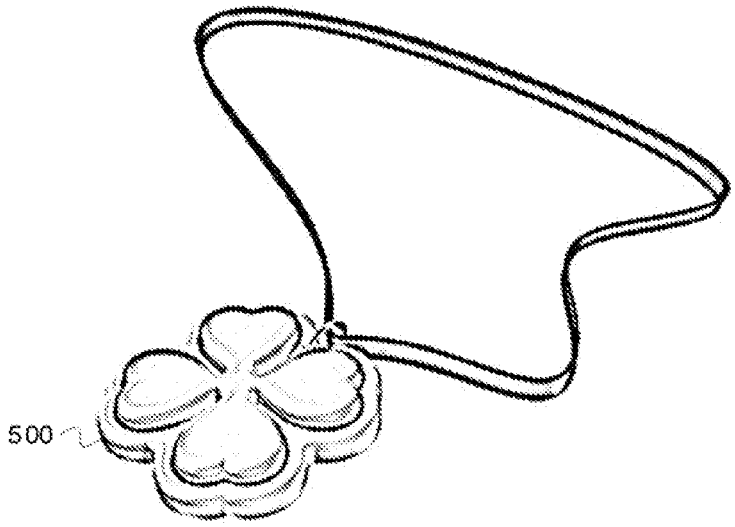
FIG. 5A is a diagrammatic illustration of an embodiment of a patron service device for use in playing wagering game machines.
Figure 5B:
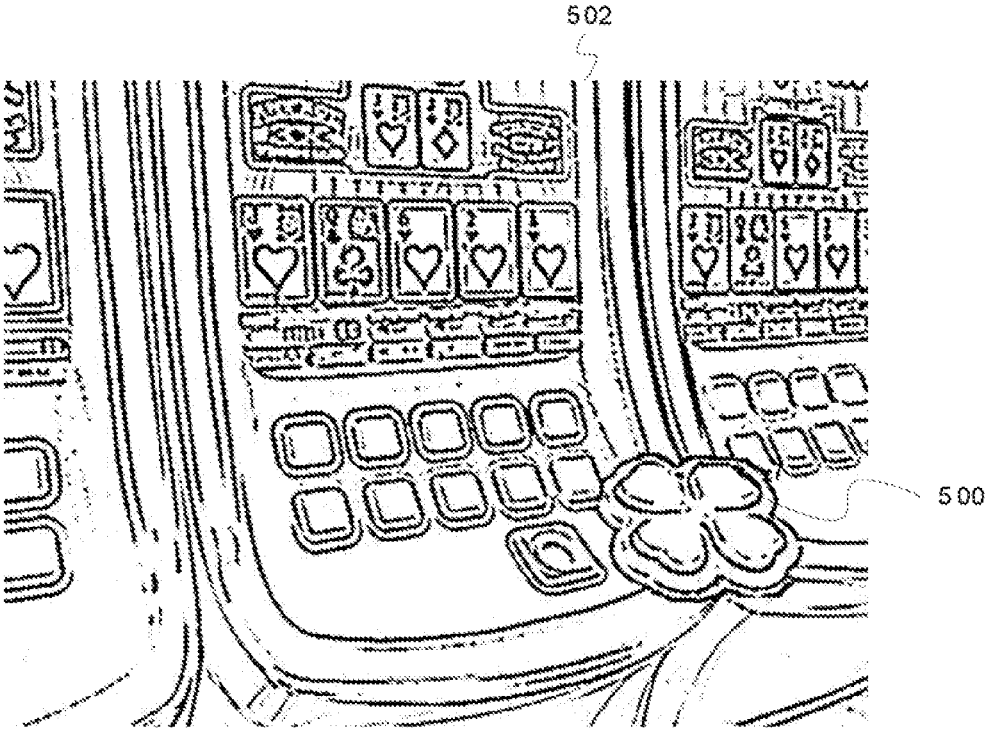
FIG. 5B is a diagrammatic illustration of a patron service device in use with a wagering game machine, according to example embodiments of the invention.

The patron service device 402 can be a standalone device or it can be included in a cell phone, personal digital assistant, two-way pager, or other device. In some embodiments, the patron service device 402 can be incorporated into a device used in playing wagering game machines. FIGS. 5A & 5B describe such a device.

FIG. 5A is a diagrammatic illustration of an embodiment of a patron service device for use in playing wagering game machines. In FIG. 5A, the patron service device 500 has a good luck charm (i.e., a shamrock) form factor, while other embodiments can have any suitable form factor. Although not shown in FIG. 5A, the patron service device 500 can include the components described in the discussion of FIG. 4. FIG. 5B shows how some embodiments of the patron service device 500 can be used with wagering game machines.

FIG. 5B is a diagrammatic illustration of a patron service device for use with a wagering game machine, according to example embodiments of the invention. As shown, a patron can place the patron service device 500 over a frequently pressed button (e.g., a spin reels button) of a wagering game machine 502. As the patron presses the patron service device 500, the pressure actuates the button, causing the wagering game machine 502 to operate and respond. Although not shown, the patron service device 500 can include a notch or cutout that fits snuggly about the button's bezel, holding the device 500 in place. In some embodiments, the device 500 can include other facilities for holding it fast to the wagering game machine 502.

In some embodiments, the patron service device 500 can work with player tracking systems. For example, before a patron plays a wagering game, the patron service device 500 can wirelessly transmit the patron's player tracking information (e.g., patron identifier, wagering game preferences, etc.) to a wagering game machine 502. The wagering game machine 502 can itself process the patron information or it can forward the patron information to a wagering game server or other device. As such, the patron service device 500 can also perform the functions of a player tracking device.

Patron Services Servers

Figure 6:
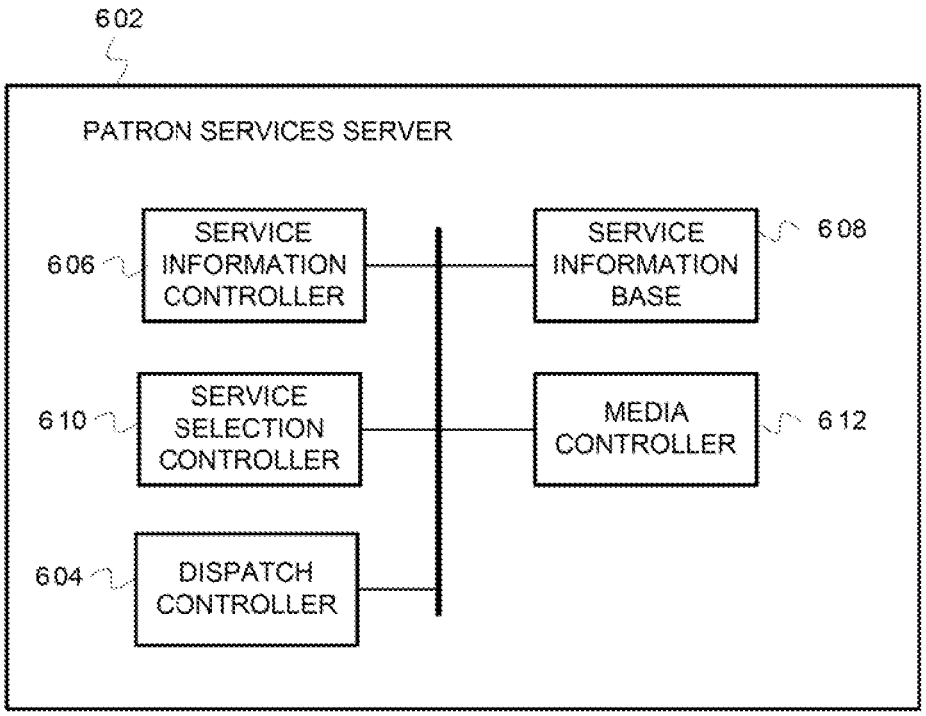
FIG. 6 is a block diagram illustrating a patron services server, according to some embodiments of the invention.

FIG. 6 is a block diagram illustrating a patron services server, according to some embodiments of the invention. In FIG. 6, the patron services server 602 includes a service information controller 606, service information based 608, service selection controller 610, dispatch controller 604, and media controller 612.

In some embodiments, the service information controller 606 can receive service information from wagering game machines, patron service devices, and other wagering game network devices. The service information controller 606 can store the service information in the service information base 608. Additionally, the service information controller can include logic for paging players, as described in more detail below. In some embodiments, the service information base 608 includes information about specific patrons. For example, the service information based 608 may include information indicating a patron's favorite beverages, wagering games, foods, hotel rooms, etc.

The service selection controller 610 can use the service information to select services for a patron, while the dispatch controller 604 can dispatch attendants and/or perform other operations for delivering selected services. The media controller 602 can transmit and receive media streams in the course of providing patron services.

The next section describes operations for some embodiments of the invention.

Example Operations

This section describes operations performed by some embodiments of the invention. In the discussion below, the flow diagrams will be described with reference to the block diagrams presented above. In certain embodiments, the operations are performed by executing instructions residing on machine-readable media (e.g., software), while in other embodiments, the operations are performed by hardware and/or other logic (e.g., firmware). In some embodiments, the operations are performed in series, while in other embodiments, one or more of the operations can be performed in parallel. Some embodiments can perform less than all of the operations shown in the flow diagrams, while other embodiments can perform loop through the operations multiple times.

Processing Patron Service Information and Delivering Patron Services

Figure 7:
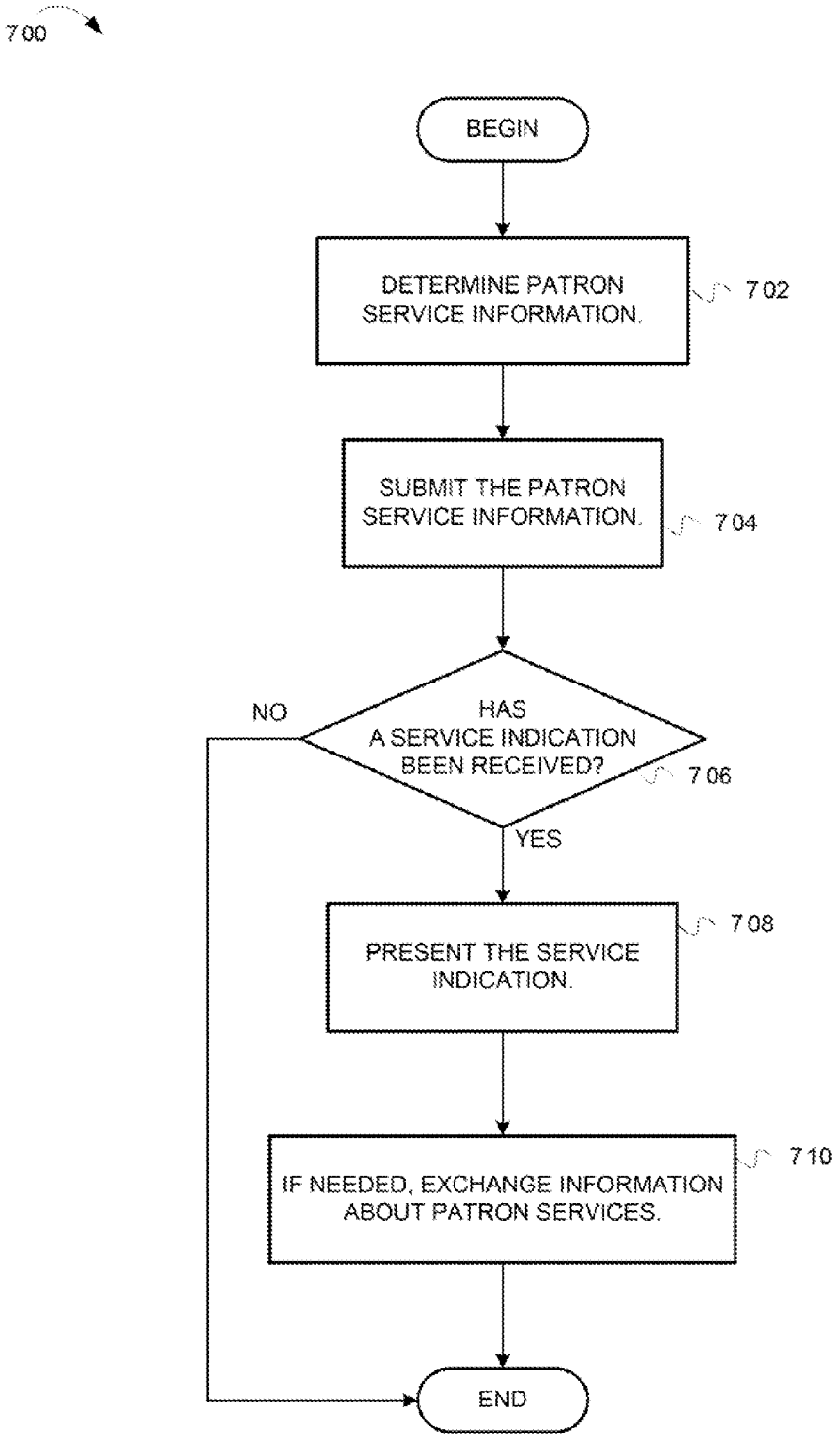
FIG. 7 is a flow diagram illustrating operations for determining and transmitting patron service information, according to example embodiments of the invention.

FIG. 7 is a flow diagram illustrating operations for determining and transmitting patron service information, according to example embodiments of the invention. In the following discussion, the flow 700 is described as being performed by embodiments of a wagering game machine. However, in some embodiments, a patron service device can also perform the operations of the flow 700. The flow diagram 700 begins at block 702.

At block 702, a wagering game machine's service information controller 336 determines a set of patron service information. The controller 336 can determine the patron service information in an automated manner (e.g., when the patron enters a certain part of a casino, at periodic time intervals, etc.) or in response to an explicit request for service (e.g., the patron selects a service through a user interface). The patron service information can include information indicating the patron's personal information, services requested, wagering game machine's geographic location, number of wagering games played, amount wagered, length of gaming session, etc. The flow continues at block 704.

At block 704, the wagering game machine's service information controller 336 submits the patron service information to a patron services server 222. In some embodiments, the patron services server 222 uses the patron service information to select services for a patron without the patron explicitly requesting those services. The flow continues at block 706.

At block 706, the service information controller 336 determines whether a service indication has been received. In some embodiments, the controller 336 receives a service indication from the patron services server 222, where the service indication indicates services or events of interest to the patron. For example, service indications can inform the patron that a drink is being delivered, that a wagering game tournament is about to begin, etc. If a service indication is received, the flow continues at block 708. Otherwise, the flow ends.

At block 708, the controller 336 presents the service indication on the primary display 310. The flow continues at block 708.

At block 710, if needed, the handheld wagering game machine 306 exchanges information about patron services. For example, in some embodiments, the patron can communicate with service personnel via text messages, voice messages, media streams, etc. From block 710, the flow ends.

While FIG. 7 describes operations for determining and transmitting patron service information, this section continues with a description of operations for using the patron service information to select patron services.

Figure 8:
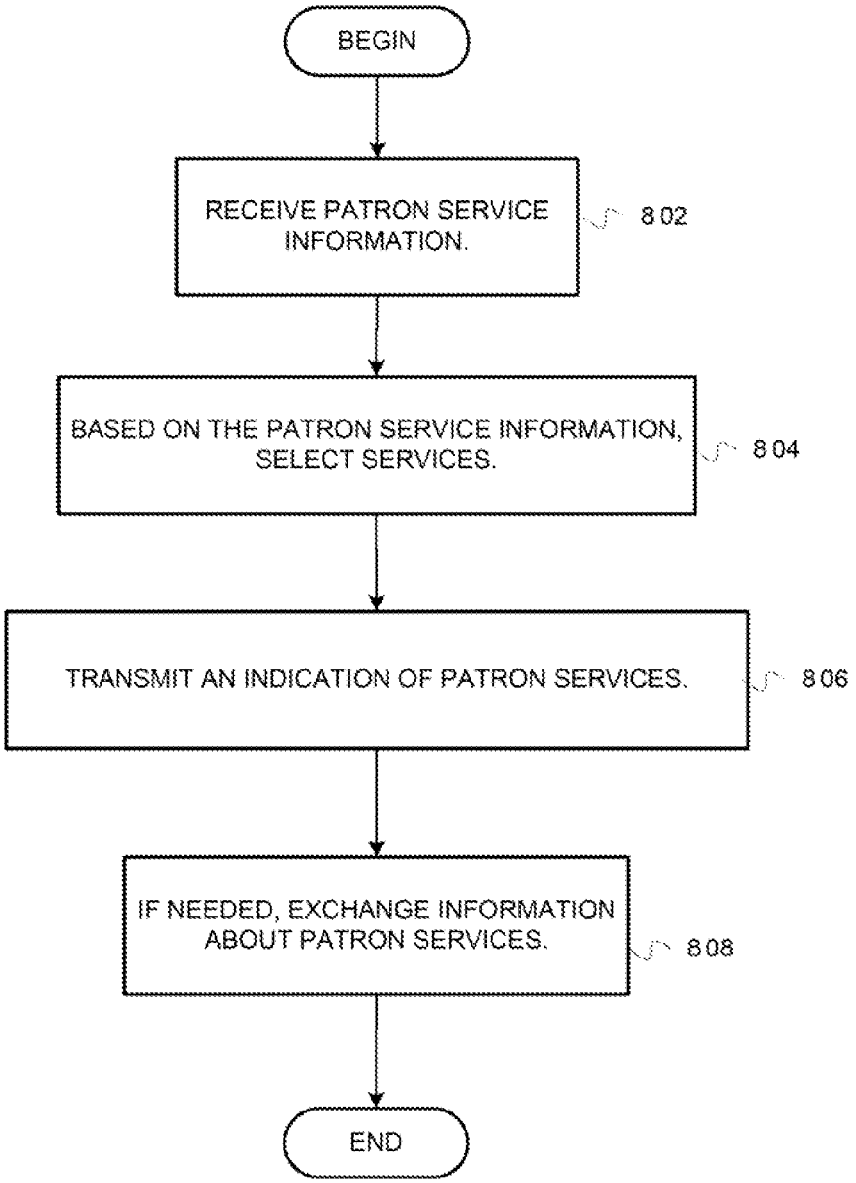
FIG. 8 is a flow diagram illustrating operations for using patron service information to select patron services, according to example embodiments of the invention.

FIG. 8 is a flow diagram illustrating operations for using patron service information to select patron services, according to example embodiments of the invention. The flow 800 begins at block 802.

At block 802, a patron services server's service information controller 606 receives patron service information from a wagering game machine 202 or patron service device 228. As noted above, the patron service information can include information indicating the patron's personal information, services requested, wagering game machine's geographic location, number of wagering games played, amount wagered, length of gaming session, etc. The flow continues at block 804.

At block 804, based on the patron service information, the patron services server's service selection controller 610 selects services for a patron. For example, if the patron service information indicates that a patron recently entered a lounge area, the service selection controller 610 can order a drink for the patron. As another example, if the patron service information indicates that a patron has spent $1000 playing wagering games, the patron services server 222 can dispatch a service attendant to greet the patron and offer various complimentary gifts. As explained in these examples, the service selection controller 610 can select services for a patron without the patron requesting the services. However, in some embodiments, the service selection controller 610 can select services based on explicit requests for service. The flow continues at block 806.

At block 806, the patron services server's dispatch controller 604 transmits an indication of patron services. In some embodiments, the dispatch controller 604 transmits the indication to a patron services terminal 226, which instructs service attendants 222 to deliver the selected services. Because some patron services terminals 226 are wireless devices (see FIG. 2), attendants can receive service notifications while moving about a casino. Additionally, the dispatch controller 604 can transmit an indication of patron services to a wagering game machine 202 to inform a patron about forthcoming services. The flow continues at block 808.

At block 808, if needed, the patron services server's media controller 612 exchanges information about patron services. For example, the media controller 612 can facilitate communications (e.g., text messages, voice messages, media streams, etc.) between the service attendants 220 and patrons (not shown). From block 808, the flow ends.

Attendant Devices

Figure 9:
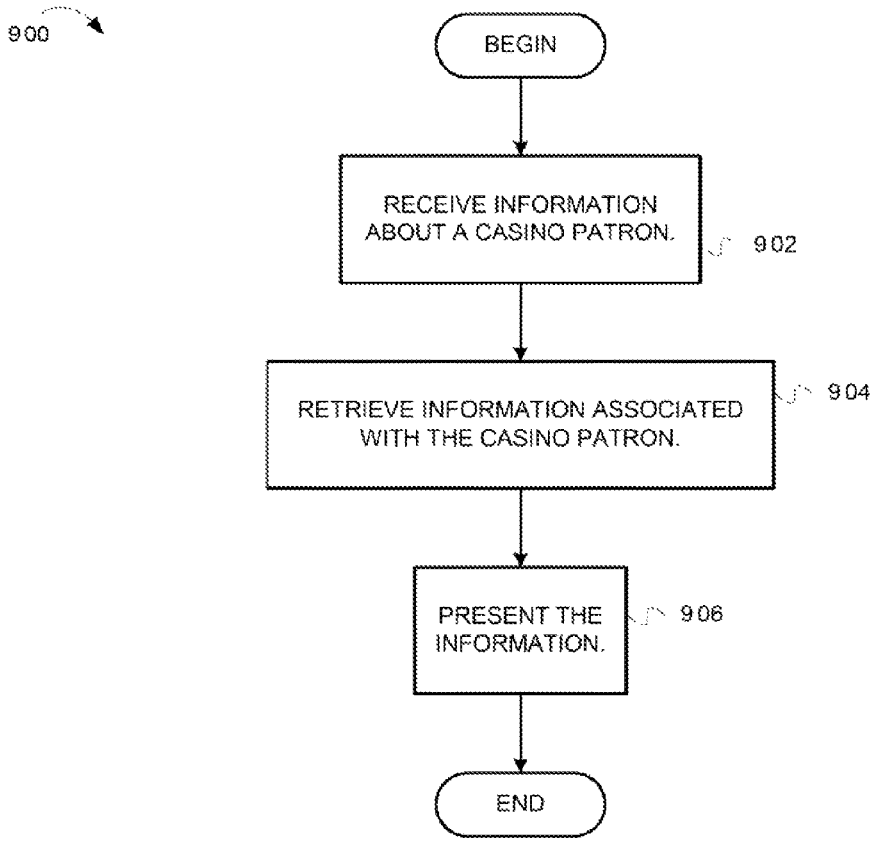
FIG. 9 is a flow diagram illustrating operations for presenting patron-specific information to service attendants, according to example embodiments of the invention.

In the discussion above, the patron services server 222 presents information (e.g., service requests) on the patron services terminal 226. In some embodiments, the patron services terminal 226 is a wireless portable device that service attendants can carry about the casino 202. In some embodiments, the patron service terminal 226 can provide patron information to service attendants 220, as they work on the casino floor. FIG. 9 describes some of these embodiments.

FIG. 9 is a flow diagram illustrating operations for presenting patron-specific information to service attendants, according to example embodiments of the invention. The flow 900 begins at block 902.

At block 902, the patron service terminal 226 receives information about a casino patron. In some embodiments, when a patron carries a wagering game machine or patron service device to certain casino areas, the patron services server 222 transmits information about the patron to a patron service terminal in those casino areas. Service attendants can use this information to learn more about valued patrons in their service area. The flow continues at block 904.

At block 904, the patron service terminal 226 retrieves additional information associated with the casino patron. In some embodiments, a service attendant 220 can use the patron services terminal 226 to request additional information about a patron (e.g., the patron's favorite wagering games, drinks, seats, etc.). The flow continues at block 906.

At block 906, the patron service terminal 226 presents the patron information. As a result, service attendants can provide highly personalized service to valued patrons. From block 906, the flow ends.

Awards Servers

In some embodiments, awards servers can facilitate promotional programs in which promotional items are distributed to casino patrons through their casino accounts. The promotional items can be used in connection with wagering games. For example, the awards can include wagering game credits, game pieces for use in a wagering game, free spins, etc. In some embodiments, an award server can award promotional items (e.g., wagering game credits, coupons, food, etc.) to a patron's casino account, but the award is revealed to the patron only after the patron initiates a wagering game session on a wagering game machine. In some embodiments, instead of revealing the award during a wagering game session, an award server can reveal the award using email, instant messages, voice messages, etc. As a result, the promotional program creates excitement and curiosity about whether patrons have received promotional awards since their last gaming session.

Figure 10:
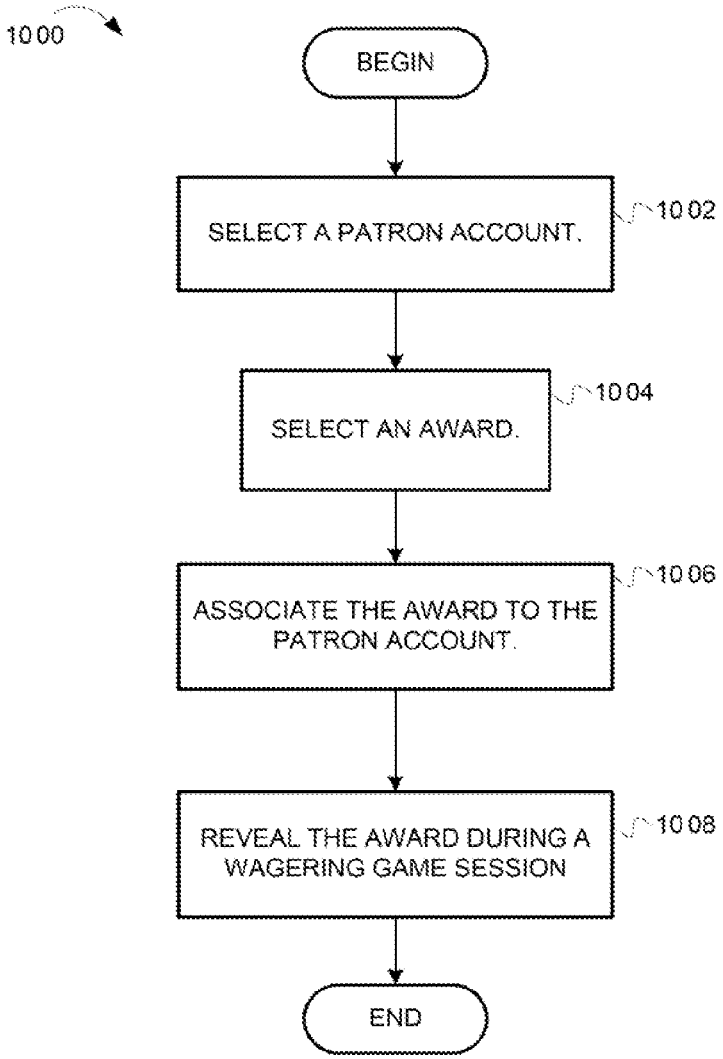
FIG. 10 is a flow diagram illustrating operations for implementing a promotional program, according to example embodiments of the invention.

According to some embodiments, awards servers can distribute promotional items at random. For example, awards servers can randomly select patrons and promotional items, awarding the selected items to the selected patrons. Alternatively, the awards server can randomly distribute awards based on patron activities in a casino, such as overall spending in the casino, type of wagering games played, winnings, movement about the casino, etc. For example, the awards server can randomly award promotional items to patrons who played certain types of wagering games, won certain amounts, went to certain areas of the casino, etc. Other embodiments can select patrons and awards in any other suitable manner. FIG. 10 describes operations for implementing one such promotional program.

FIG. 10 is a flow diagram illustrating operations for implementing a promotional program, according to example embodiments of the invention. The flow diagram 1000 begins at block 1002.

At block 1002, the awards server 230 selects an account associated with a patron. Flow continues at block 1004.

At block 1004, the award server 230 selects a promotional award. In some embodiments, the promotional award can include wagering game credits, coupons, food, or other suitable goods and services. The flow continues at block 1006.

At block 1006, the award server 230 associates the award to the patron account. In some embodiments, the award server 230 credits or otherwise configures the patron account to indicate the award. The flow continues at block 1008.

At block 1008, the award server 230 reveals the award during a wagering game session. In some embodiments, the award server 230 instructs the wagering game server 206 to reveal the award upon commencement of the patron's next wagering game session. In some embodiments, the patron can redeem the award using a player account card, patron service device, or other device associated with the patron's casino account. From block 1008, the flow ends.

While the embodiments discussed above distribute awards using patron accounts, other embodiments can distribute awards without using patron accounts. For example, the awards server 230 can select gaming sessions in which it distributes promotional awards. During a patron's gaming session, the award server 230 can present codes or other indicia indicating that the patron has been awarded a particular promotional item. The patron can redeem the promotional item by presenting the code or other indicia to casino attendants 220.

Services Via Media

This discussion continues with some additional embodiments. In some of the embodiments described below, a wagering game machine or patron service device can select patron services based on patron service information. Additionally, the wagering game machine or patron service device can exchange media streams with a patron services server in the course of providing services to a patron.

Figure 11:
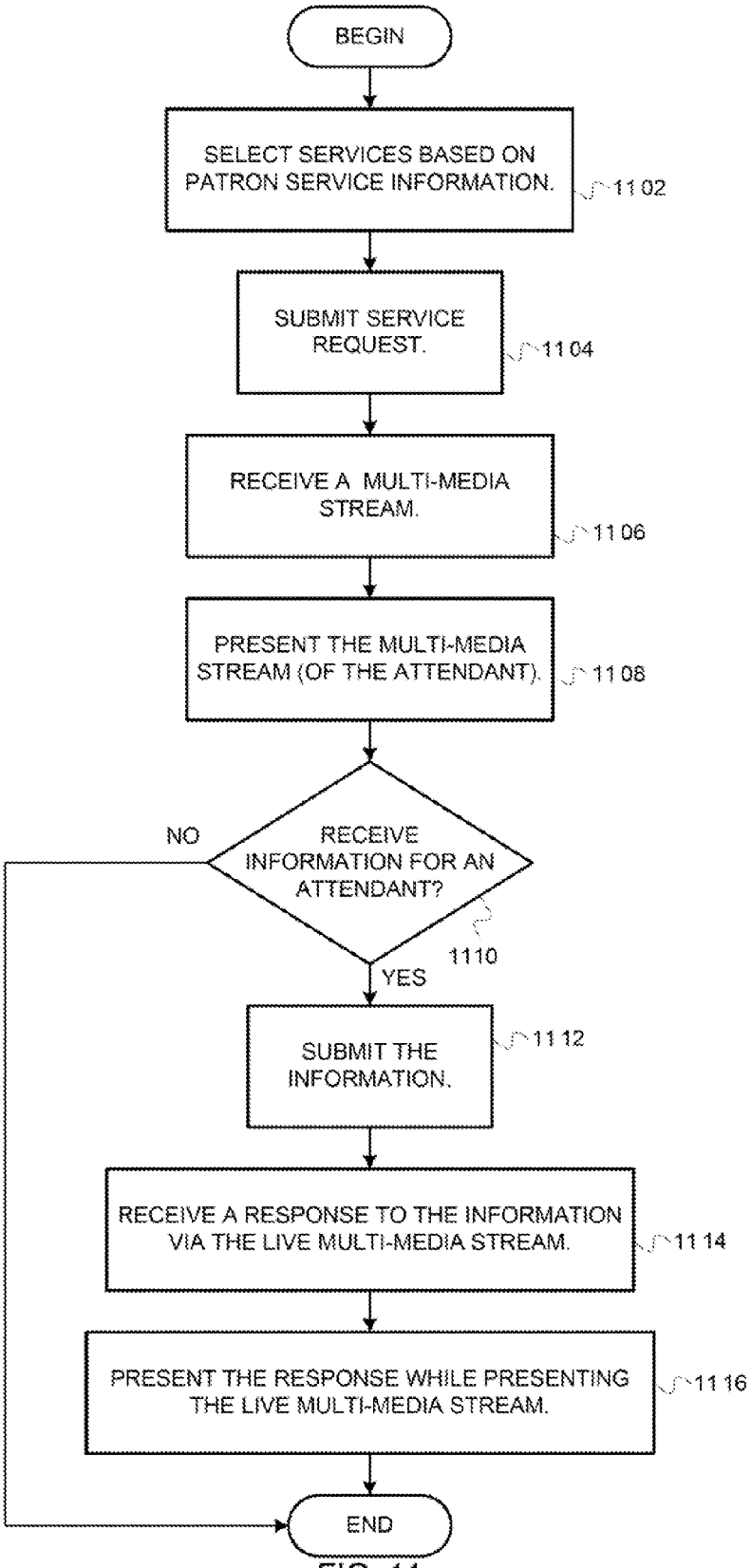
FIG. 11 is a flow diagram illustrating operations for requesting patron services based on patron service information, according to example embodiments of the invention.

FIG. 11 is a flow diagram illustrating operations for requesting patron services based on patron service information, according to example embodiments of the invention. The flow 1100 begins at block 1102.

At block 1102, a wagering game machine 202 uses patron service information to select one or more services for a patron. In some embodiments, the patron service information can indicate that a patron directly requested a particular service. However, the wagering game machine 202 can select patron services without the patron directly requesting the services (e.g., using location information, wagering game information, etc.). The patron services can include reservation services, casino information services, technical support, food/beverage delivery, etc. The flow continues at block 1104.

At block 1104, the wagering game machine 202 submits a request for the selected patron services. In some embodiments, the wagering game machine 202 submits the request to a patron services server 222 over a wireless link 210. The flow continues at block 1106.

At block 1106, the wagering game machine 202 receives a multimedia stream from the patron services server 222. The multimedia stream can include audio, video, text, and other communications from a service attendant 220. For example, if a patron wants to make restaurant reservations, receive technical support, or receive other information, the patron can communicate with a service attendant 220 via the multimedia stream. In some embodiments, the patron contacts the same service attendant 220 for all services. The multimedia stream can facilitate live communications or it can include prerecorded service information. The flow continues at block 1108.

At block 1108, wagering game machine 202 determines whether it has received information in response to the multimedia stream. For example, the wagering game machine 202 determines whether a patron has provided information (e.g., a text message, voice message, audio/video message, etc.) for a service attendant 220. If the wagering game machine 202 has received information in response to the multimedia stream, the flow continues at block 1112. Otherwise, the flow ends.

At block 1112, the wagering game machine 202 submits the information to the patron services server 222. In some embodiments, the information is delivered to a service attendant 220. The flow continues at block 1114.

At block 1114, the wagering game machine 202 receives a response from the patron services server 222. In some embodiments, the response is part of a multimedia stream including additional communications from the service attendant 220. The flow continues at block 1116.

At block 1116, the wagering game machine 202 presents the response on its primary display. From block 1116, the flow ends.

This section continues with a discussion of embodiments that use live and pre-recorded multimedia streams to deliver patron services in a casino.

Figure 12:
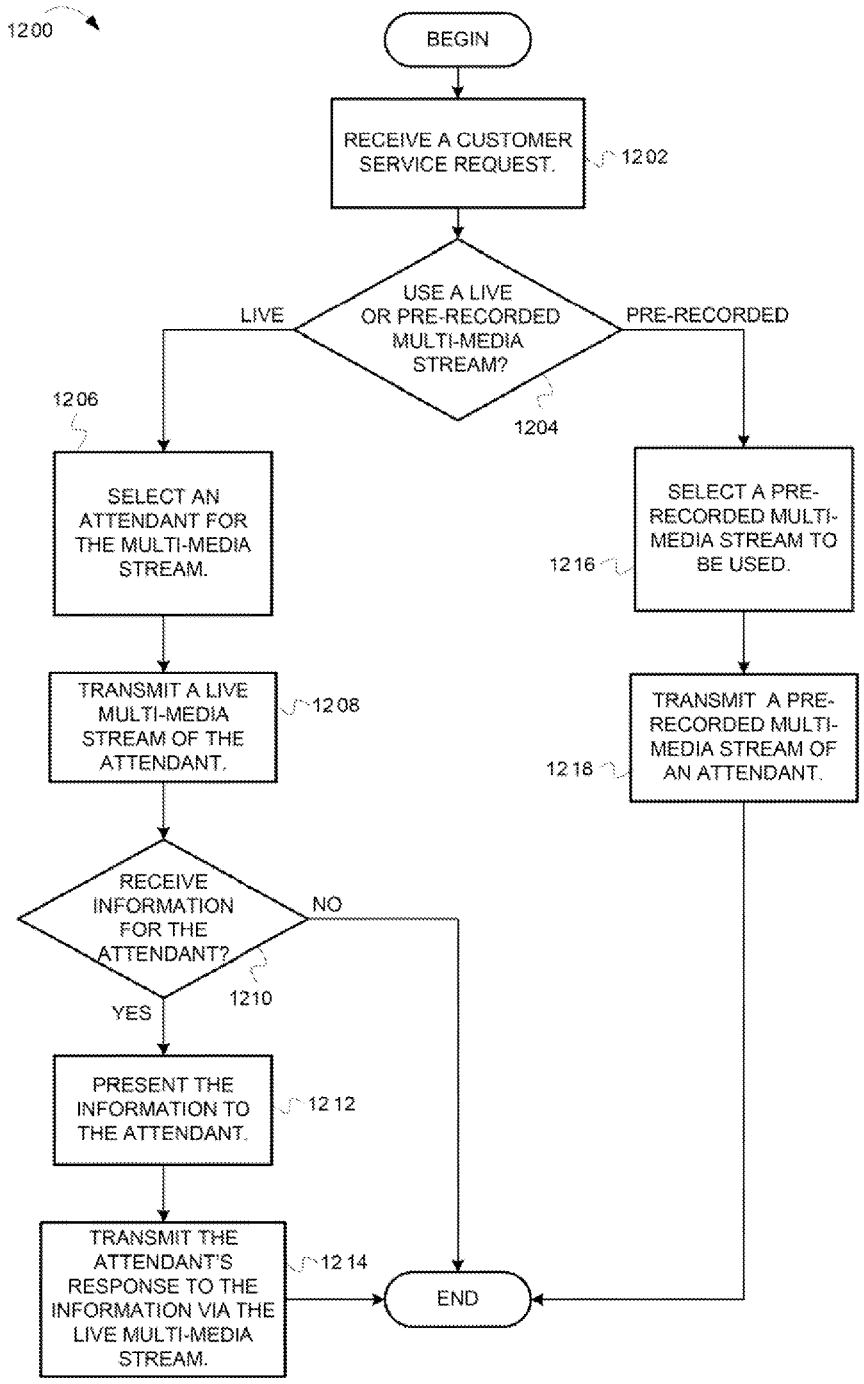
FIG. 12 is a flow diagram illustrating operations transmitting live and prerecorded multimedia streams to deliver patron services, according to example embodiments of the invention.

FIG. 12 is a flow diagram illustrating operations transmitting live and prerecorded multimedia streams to deliver patron services, according to example embodiments of the invention. The flow 1200 begins at block 1202.

At block 1202, the patron services server 222 receives a patron service request. For example, the patron services server 222 receives a request to make dinner reservations from a wagering game machine 202. The flow continues at block 1204.

At block 1204, the patron services server 222 determines whether it will use live or prerecorded multimedia stream in its response to the patron service request. If the patron services server 222 uses a live multimedia stream, the flow continues at block 1206. Otherwise, the flow continues at block 1216.

At block 1206, the patron services server 222 selects a service attendant 220 for the live multimedia stream. The flow continues at block 1208.

At block 1208, the patron services server 222 transmits a live multimedia stream that includes communications from the service attendant 220. The flow continues at block 1210.

At block 1210, the patron services server 222 determines whether it has received information for the attendant. In some embodiments, the information is included in a live multimedia stream. If the patron services server 222 receives information for the attendant, the flow continues at block 1212. Otherwise, the flow ends.

At block 1212, the patron services server presents the information to the attendant. In some embodiments, the information is presented as part of a multimedia stream. The flow continues at block 1214.

At block 1214, the patron services server 222 transmits a live multimedia stream including a response from the attendant. From block 1214, the flow ends.

As noted above, if the patron services server 222 uses a prerecorded multimedia stream, the flow continues from block 1204 to block 1216. At block 1216, the patron services server 222 selects a prerecorded multimedia stream. In some embodiments, the prerecorded multimedia stream includes audio and video footage of a virtual service attendant. The prerecorded multimedia stream can include information relevant to the service request received at block 1202. The flow continues at block 1218.

At block 1218, the patron services server 222 transmits the prerecorded multimedia stream to a wagering game machine 202. From block 1218, the flow ends.

Paging Players

This discussion continues with embodiments in which wagering game systems can page players when specific machines are available for play (i.e., not being used by other players). In some instances, wagering game machines are marked with identifiers. If players want to receive pages when particular wagering game machines are available, the players can text identifiers to a messaging service associated with a patron services server (or other device). In turn, the patron services server can monitor the wagering game machines and send pages (e.g., text, voice, etc.) when the wagering game machines are available for play. This allows players to participate in other casino activities while waiting for desired machines to become available. Also, it can alleviate crowding, lurking, etc. The following discussion of FIGS. 13 & 14 describes these and other embodiments.

Figure 13:
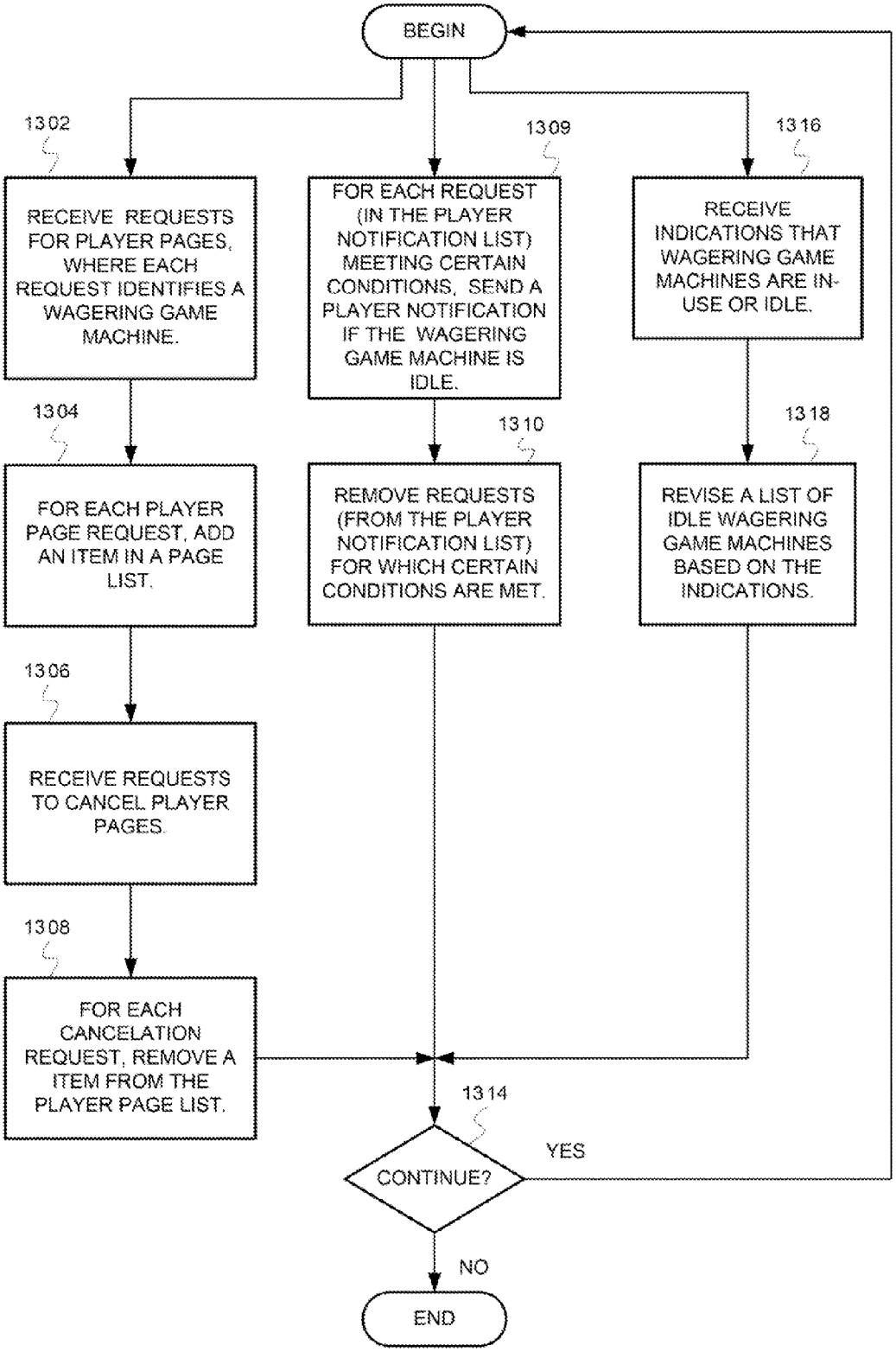
FIG. 13 is a flow diagram illustrating operations for processing player page requests, according to some embodiments of the invention.

FIG. 13 is a flow diagram illustrating operations for processing player page requests, according to some embodiments of the invention. As noted above, players can send page requests when machines of interest are occupied. A wagering game system can process the page requests using the operations shown in the flow 1300. In some embodiments, a patron services server (see discussion of FIG. 2) can perform the flow 1300.

The flow 1300 includes three operation paths beginning at blocks 1302, 1308, and 1316, respectively. At block 1302, a patron services server's service information controller 606 receives player page requests. The service information controller 606 can receive the requests as text messages and telephone messages over the communications network 214. The text messages can be: 1) in the Multimedia Messaging Service format defining messages including multimedia objects (images, audio, video, rich text), 2) in the Short Message Service format defining text messages, or 3) in any other suitable format. The controller 606 can also receive requests through web interfaces, from application programs, or through any other suitable facilities. In some instances, the requests can indicate conditions under which pages should be sent. For example, requests can specify certain wagering game machines, time periods for sending pages, number of pages to be sent, frequency with which pages should be sent, etc. Requests can ask for pages when specific machines become free or when other events occur (e.g., a specific machine awards a large jackpot, a social contact wins a jackpot, etc.). The requests can explicitly include a contact number for the page or the controller 606 can determine a contact information using other means, such as caller ID, IP addresses, etc. The flow continues at block 1304.

At block 1304, for each page request received, the service information controller 606 adds an item to a page list. The page list can include players to page and page conditions. The page list can be stored in a relational database or any other suitable data structure, and it can reside in the server information base 608. The flow continues at block 1306.

At block 1306, the service information controller 606 receives requests to cancel pages. Although page requests may themselves indicate when pages should cease (see discussion of conditions above), players can explicitly request cancellation of pages via text message, voice message, web interface, etc. The flow continues at block 1308.

At block 1308, for each cancellation request, the service information controller 606 removes a page request from the page list. The flow continues at 1314.

At block 1314, if the service information controller 606 will continue processing page requests, the flow continues at blocks 1302, 1308, and 1316. Otherwise, the flow ends.

As for the operation path beginning at block 1309, for each request in the page list that meets specified conditions, the service information controller 606 pages a player (e.g., to notify the player that a wagering a machine is available). As noted above, the page requests can indicate conditions that should be satisfied before pages are sent (e.g., when a specific wagering a machine is available, a time period in which to send the pages, frequency with which pages should be sent, etc.). In some embodiments, the service information controller 606 traverses the page list checking conditions for each entry. In addition to the page list, the controller 606 can inspect a status list indicating which wagering game machines are available (see discussion of block 1316 below). If an entry's conditions are met (e.g., if a specified wagering game machine is available), the controller 606 pages the player.

The controller 606 can page players by sending text or voice messages to players' telephones. The text messages can include directions and images indicating where the machine is located within a casino. The text messages can also include hyperlinks to casino maps, information about the wagering game machine, or other information that may interest players. Some embodiments can page players by playing audible messages over a public address system, by displaying a message on a ticker or other display device, etc. The flow continues at block 1310.

At block 1310, the service information controller 606 removes requests (from the page list) for which certain conditions are met. For example, if a time period specified in a request has expired, the controller 606 removes the request from the page list. The flow continues at block 1314.

As for the operation path beginning at block 1316, the service information controller 606 receives status messages (or other indicia) indicating that wagering game machines are in-use or idle. For example, wagering game machines notify the service information controller 606 when they become available and when they change from available to in-use. The flow continues at block 1318.

At block 1318, the controller 606 revises a wagering game machine status list based on the indications received at block 1316. The status list can be stored in a relational database or other suitable data structure in the server information base 608. The flow continues at block 1314. This discussion continues with a description of FIG. 14, which describes how wagering game machines can notify the server (or other devices) when they become available for change from available to in-use.

Figure 14:
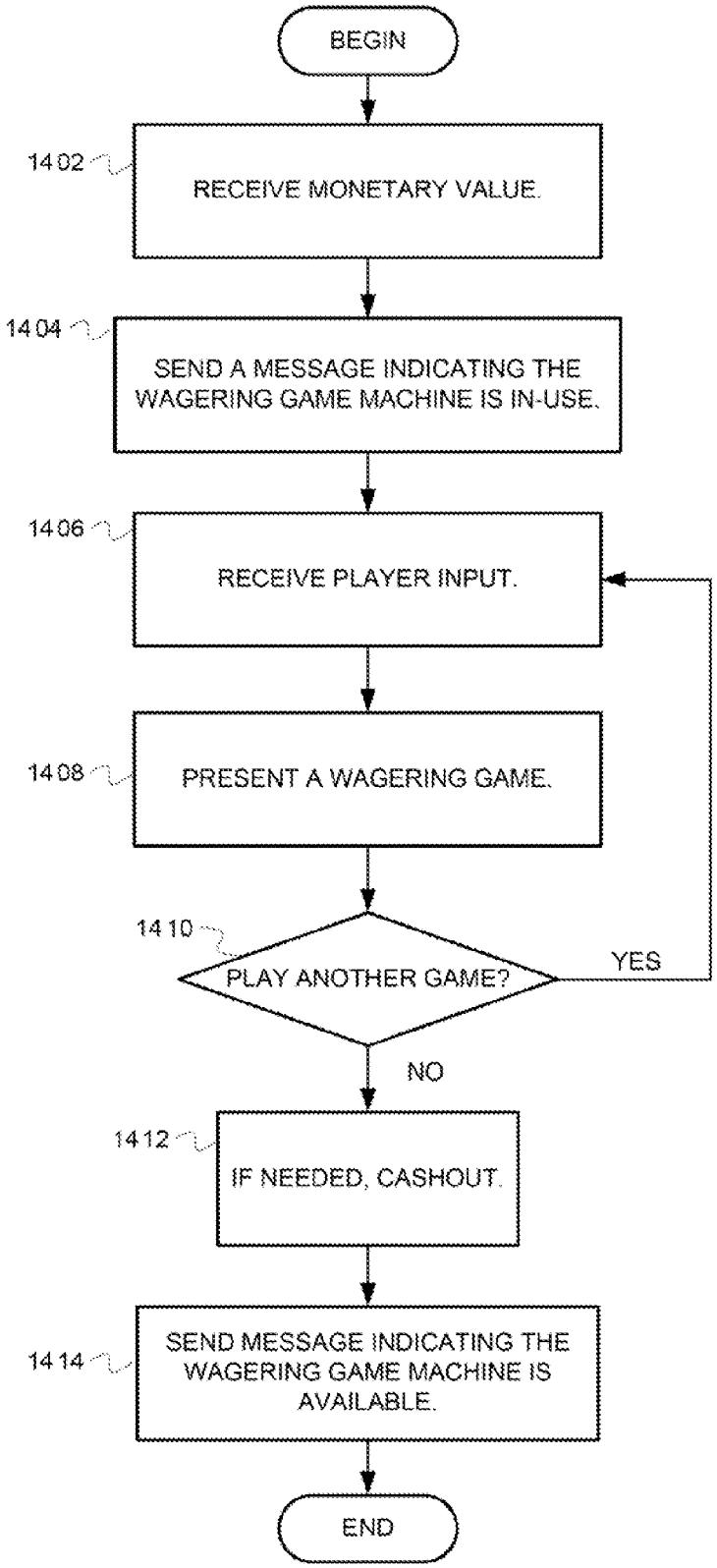
FIG. 14 is a flow diagram illustrating operations for reporting a wagering game machine's availability to a player paging system, according to embodiments of the invention.

FIG. 14 is a flow diagram illustrating operations for reporting a wagering game machine's availability to a player paging system, according to embodiments of the invention. The flow 1400 begins at block 1402.

At block 1402, a wagering game machine 202 receives monetary value for making wagers in wagering games. The wagering a machine 202 can receive the monetary value electronically via a player account system, or by way of players inserting cash, vouchers, etc. into the machine's bill/voucher validators or other devices. The flow continues at block 1404.

At block 1404, the wagering game machine 202 transmits a message to the patron services server 222, where the message indicates that wagering game machine is in-use. In some embodiments, when the wagering game machine receives monetary value for playing wagering games, it is "in-use." As discussed above, the patron services server 222 can use the message to determine whether the wagering game machine is available. The flow continues at block 1406.

At block 1406, the wagering a machine 202 receives players input associated with a wagering game. Flow continues at block 1408.

At block 1408, wagering game machine 202 presents results for the wagering game. The flow continues at block 1410.

At block 1410, the wagering game machine 202 determines whether it will present another wagering game. The machine 202 may play another wagering game if there is sufficient monetary value available for placing wagers. For example, if there is sufficient monetary value and the machine 202 detect player input initiating another game, the flow will continue at block 1406. However, if there is no monetary value or if the machine's "cash out" button is pressed, the flow will continue at block 1412.

At block 1412, the wagering game machine returns to the player any monetary value remaining on its credit meter (a.k.a. game session account). This can involve electronically transferring funds, dispensing vouchers, dispensing cash, etc. The flow continues at block 1414.

At block 1414, the wagering a machine 202 transmits a message to the patron services server, where the message indicates that the machine is available. After receiving this message, the patron services server 222 can notify players that the wagering game machine 202 is available. From block 1414, the flow ends.

Although FIGS. 13 and 14 describe some embodiments, other embodiments can operate differently. For example, instead of a centralized device receiving messages for a group of wagering game machines (see discussion of FIG. 13), each wagering game machine could itself receive and process page requests. In such embodiments, the wagering game machines could include logic for performing operations similar to those in FIG. 13. Also, in these embodiments, the wagering game machines need not report their availability, as described in FIG. 14.

Wagering Game Machines

This section presents some additional features of wagering game machines.

Figure 15:
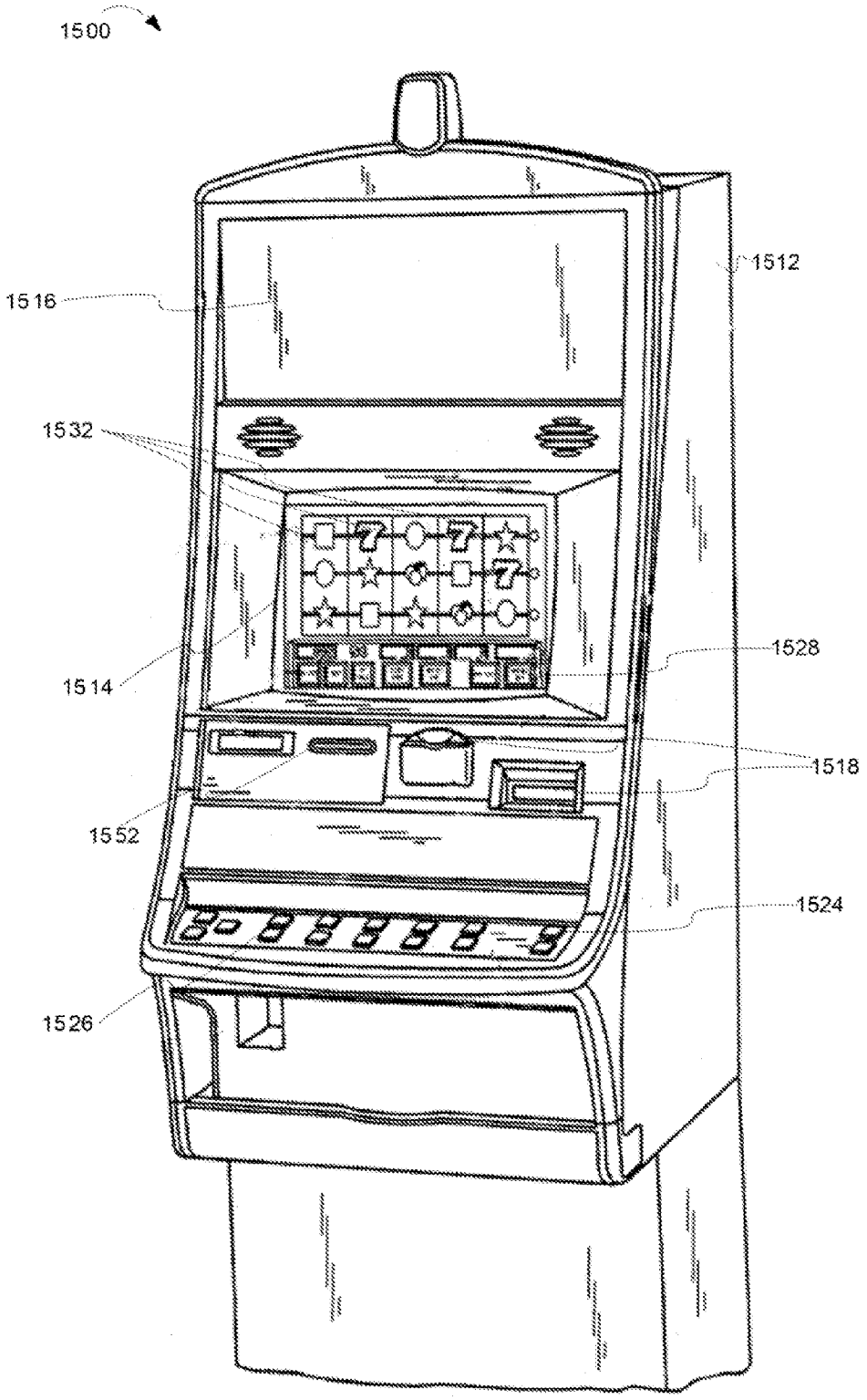
FIG. 15 is a perspective view of a wagering game machine, according to example embodiments of the invention.

FIG. 15 is a perspective view of a wagering game machine, according to example embodiments of the invention. Referring to FIG. 15, a wagering game machine 1500 is used in gaming establishments, such as casinos. According to embodiments, the wagering game machine 1500 can be any type of wagering game machine and can have varying structures and methods of operation. For example, the wagering game machine 1500 can be an electromechanical wagering game machine configured to play mechanical slots, or it can be an electronic wagering game machine configured to play video casino games, such as blackjack, slots, keno, poker, blackjack, roulette, etc.

The wagering game machine 1500 comprises a housing 1512 and includes input devices, including value input devices 1518 and a player input device 1524. For output, the wagering game machine 1500 includes a primary display 1514 for displaying information about a basic wagering game. The primary display 1514 can also display information about a bonus wagering game and a progressive wagering game. The wagering game machine 1500 also includes a secondary display 1516 for displaying wagering game events, wagering game outcomes, and/or signage information. While some components of the wagering game machine 1500 are described herein, numerous other elements can exist and can be used in any number or combination to create varying forms of the wagering game machine 1500.

The value input devices 1518 can take any suitable form and can be located on the front of the housing 1512. The value input devices 1518 can receive currency and/or credits inserted by a player. The value input devices 1518 can include coin acceptors for receiving coin currency and bill acceptors for receiving paper currency. Furthermore, the value input devices 1518 can include ticket readers or barcode scanners for reading information stored on vouchers, cards, or other tangible portable storage devices. The vouchers or cards can authorize access to central accounts, which can transfer money to the wagering game machine 1500.

The player input device 1524 comprises a plurality of push buttons on a button panel 1526 for operating the wagering game machine 1500. In addition, or alternatively, the player input device 1524 can comprise a touch screen 1528 mounted over the primary display 1514 and/or secondary display 1516.

The various components of the wagering game machine 1500 can be connected directly to, or contained within, the housing 1512. Alternatively, some of the wagering game machine's components can be located outside of the housing 1512, while being communicatively coupled with the wagering game machine 1500 using any suitable wired or wireless communication technology.

The operation of the basic wagering game can be displayed to the player on the primary display 1514. The primary display 1514 can also display a bonus game associated with the basic wagering game. The primary display 1514 can include a cathode ray tube (CRT), a high resolution liquid crystal display (LCD), a plasma display, light emitting diodes (LEDs), or any other type of display suitable for use in the wagering game machine 1500. Alternatively, the primary display 1514 can include a number of mechanical reels to display the outcome. In FIG. 15, the wagering game machine 1500 is an "upright" version in which the primary display 1514 is oriented vertically relative to the player. Alternatively, the wagering game machine can be a "slant-top" version in which the primary display 1514 is slanted at about a thirty-degree angle toward the player of the wagering game machine 1500. In yet another embodiment, the wagering game machine 1500 can exhibit any suitable form factor, such as a free standing model, bartop model, mobile handheld model, or workstation console model.

A player begins playing a basic wagering game by making a wager via the value input device 1518. The player can initiate play by using the player input device's buttons or touch screen 1528. The basic game can include arranging a plurality of symbols along a payline 1532, which indicates one or more outcomes of the basic game. Such outcomes can be randomly selected in response to player input. At least one of the outcomes, which can include any variation or combination of symbols, can trigger a bonus game.

In some embodiments, the wagering game machine 1500 can also include an information reader 1552, which can include a card reader, ticket reader, bar code scanner, RFID transceiver, or computer readable storage medium interface. In some embodiments, the information reader 1552 can be used to award complimentary services, restore game assets, track player habits, etc.

General

In this detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims.

The invention claimed is:

1. A method of operating a gaming system, the gaming system including one or more controllers and a plurality of wagering game machines, each gaming machine primarily dedicated to playing at least one respective casino wagering game, the gaming machine including an electronic display device and one or more electronic input devices, the method comprising:

receiving, from patron mobile phones, a plurality of text messages including page requests, wherein the page requests identify wagering game machines from the plurality of wagering game machines and indicate requests for notification when the wagering game machines are available, each wagering game machine including one or more electronic input devices configured to receive a physical item associated with a monetary value that establishes a credit balance, initiate the casino wagering game in response to an input indicative of a wager covered by the credit balance, and receive via at least one of the one or more electronic input devices a cashout input that initiates a payout from the credit balance;

receiving status messages from the wagering game machines, the status messages indicating which of the wagering game machines are available and which of the wagering game machines are in-use;

determining, for each of the page requests, that one of the wagering game machines is available, wherein the determining is based on the status messages; and transmitting, for each of the page requests, a notification to one of the patron mobile phones, the notification indicating that the one of wagering machines is available.

2. The method of claim 1, wherein one or more of the page requests indicate a time period after which no notification should be sent.

3. The method of claim 1, wherein the notification includes directions to the one of the wagering game machines.

4. A system comprising:

one or more gaming machines primarily dedicated to playing at least one casino wagering game, each gaming machine including an electronic display device, one or more electronic input devices, and one or more controllers, the one or more controllers configured to:

detect, via at least one of the one or more electronic input devices, a physical item associated with a monetary value that establishes a credit balance;

initiate the casino wagering game in response to an input indicative of a wager covered by the credit balance;

receive, via at least one of the one or more electronic input devices, a cashout input that initiates a payout from the credit balance; and a patron services server configured to:

receive, from patron mobile phones, a plurality of text messages including page requests, wherein the page requests identify wagering game machines and indicate requests for notification when the wagering game machines are available;

receive status messages from the wagering game machines, the status messages indicating which of the wagering game machines are available and which of the wagering game machines are in-use;

determine, for each of the page requests, that one of the wagering game machines is available, wherein the determination is based on the status messages; and transmit, for each of the page requests, a notification to one of the patron mobile phones, the notification indicating that the one of the wagering game machines is available.

5. The system of claim 4, wherein one or more of the page requests indicate a time period after which no notification should be sent.

6. The system of claim 4, wherein the notification includes directions to the one of the wagering game machines.

7. One or more non-transitory computer-readable storage media, having instructions stored therein, which when executed by one or more processors cause the one or more processors to perform operations comprising:

receiving, from patron mobile phones, a plurality of text messages including page requests, wherein the page requests identify wagering game machines from a plurality of wagering game machines and indicate requests for notification when the wagering game machines are available, each wagering game machine including one or more electronic input devices configured to receive a physical item associated with a monetary value that establishes a credit balance, initiate the casino wagering game in response to an input indicative of a wager covered by the credit balance, and receive via at least one of the one or more electronic input devices a cashout input that initiates a payout from the credit balance;

receiving status messages from the wagering, the status messages indicating which of the wagering game machines are available and which of the wagering game machines are in-use;

determining, for each of the page requests, that one or the wagering game machines is available, wherein the determining is based on the status messages; and transmitting, for each of the page requests, a notification to one of the patron mobile phones, the notification indicating that the one of the wagering game machines is available.

8. The one or more non-transitory computer-readable storage media of claim 7, wherein one or more of the page requests indicate a time period after which no notification should be sent.

9. The one or more non-transitory computer-readable storage media of claim 7, wherein the notification includes directions to the one of the wagering game machines.

* * * * *